US008713872B2

(12) United States Patent
Rempel

(10) Patent No.: US 8,713,872 B2
(45) Date of Patent: May 6, 2014

(54) BRACKETS FOR ASSEMBLY OF A FLOATING WALL

(75) Inventor: Bradley Duane Rempel, Greeley, CO (US)

(73) Assignee: Viking Product Development, LLC, Greeley, CO (US)

( * ) Notice: Subject to any disclaimer, the term of this patent is extended or adjusted under 35 U.S.C. 154(b) by 147 days.

(21) Appl. No.: 13/303,133

(22) Filed: Nov. 22, 2011

(65) Prior Publication Data

US 2012/0297721 A1 Nov. 29, 2012

Related U.S. Application Data

(60) Provisional application No. 61/458,445, filed on Nov. 22, 2010.

(51) Int. Cl.
*E02D 27/00* (2006.01)

(52) U.S. Cl.
USPC ..... 52/293.3; 52/238.1; 52/573.1; 52/698; 52/741.14

(58) Field of Classification Search
USPC ..... 52/167.1, 238.1, 239, 293.3, 481.1, 52/573.1, 698, 702, 704, 712, 715, 741.14
See application file for complete search history.

(56) References Cited

U.S. PATENT DOCUMENTS

| | | | | |
|---|---|---|---|---|
| 5,040,345 | A | 8/1991 | Gilmour | |
| 5,127,760 | A | 7/1992 | Brady | |
| 5,143,472 | A * | 9/1992 | Reed et al. | 403/230 |
| 5,832,691 | A * | 11/1998 | Callahan et al. | 52/481.1 |
| 6,581,353 | B2 | 6/2003 | Augustine | |
| 6,694,700 | B1 * | 2/2004 | Mackett | 52/764 |
| 7,178,305 | B2 * | 2/2007 | Petrova | 52/715 |
| 7,316,098 | B1 * | 1/2008 | Sackett | 52/92.2 |
| 7,461,493 | B2 * | 12/2008 | Quertelet et al. | 52/712 |

* cited by examiner

*Primary Examiner* — Charles A Fox
*Assistant Examiner* — Patrick Maestri
(74) *Attorney, Agent, or Firm* — Christopher P. Whitham; Cochran Freund & Young LLC

(57) ABSTRACT

Disclosed are a floating wall bracket and a method for constructing a floating wall using floating wall brackets. A floating wall bracket may have bracket walls designed to hold a vertical member with at least one fastening tab disposed perpendicular to said bracket walls, at least one attachment means to attach the at least one fastening tab to a base plate member, and at least one friction means that provides enough friction to hold the weight of the vertical member, but not so much friction that it will stop the vertical member from moving within the bracket once a floating wall assembly is incorporated into a building/structure. The bracket may also have at least one guide/lateral support flange disposed parallel to the bracket walls and sized/places to guide installation of the floating wall brackets and to provide lateral support to the vertical members of the floating wall assembly.

13 Claims, 14 Drawing Sheets

--PRIOR ART--

BRACKETS FOR ASSEMBLY OF A FLOATING WALL

CROSS REFERENCE TO RELATED APPLICATIONS

This application is based upon and claims priority to U.S. provisional application Ser. No. 61/458,445, filed Nov. 22, 2010, entitled "Bracket for Assembly of a Floating Wall and Manufacturing Method;" all of which is specifically incorporated herein by reference for all that it discloses and teaches.

BACKGROUND OF THE INVENTION

Many parts of the world, including much of the United States have expansive and/or swelling soils. Expansive and/or swelling soils present a difficult challenging for building construction since as the water content in expansive/swelling soils increases, the soil expands and/or swells. Conversely, as the water content in expansive/swelling soils decreases, the soil contracts and/or shrinks. Expansive/swelling soils can produce great forces and heave with great power, which may damage buildings constructed on the expansive/swelling soils. Hence, care must be taken when building structures on expansive/swelling soils. If not constructed with proper methods and materials, the expansion and contraction of the expansive soil may exert forces on buildings and/or structures that may cause cosmetic, or even structural, damage to the building/structure.

SUMMARY OF THE INVENTION

An embodiment of the present invention may comprise a floating wall bracket for constructing floating walls in building/structure construction comprising: bracket walls having a perimeter substantially in a shape of a cross-section of a vertical member to be placed into the floating wall bracket, the perimeter of the bracket walls substantially sized such that the cross-section of the vertical member fits within the bracket walls, the bracket walls having an open end for accepting the vertical member and a base end that abuts a floating base plate member disposed substantially perpendicular to the vertical member, the bracket walls extending from the open end toward the base end such that the vertical member may securely fit within the bracket walls, at least a portion of the bracket walls further extending to the base end, at least one fastening tab disposed from the base end of the bracket walls and extending perpendicular to the bracket walls such that the fastening tab may be aligned linearly with the floating base plate member, the at least one fastening tab having at least one attachment means for attaching the at least one fastening tab of the floating wall bracket to the floating base plate member; at least one friction means incorporated into the floating wall bracket that acts on the vertical member to support the vertical member within the floating wall bracket, the at least one friction means providing enough friction to hold the weight of the vertical member within the floating wall bracket without the vertical member freely moving within the bracket walls, the at least one friction means limiting friction provided such that the vertical member will slide within the bracket walls once a floating wall assembly comprised of at least one floating wall bracket is attached to floor joists of an upper level, the at least one friction means incorporated within the floating wall bracket such that the vertical member will have a desired amount of floating space between an end of the vertical member placed within the bracket walls of the floating wall bracket and the floating base plate member at the base end of the bracket walls.

An embodiment of the present invention may further comprise the floating wall bracket of the previous paragraph further comprising at least one guide/lateral support flange disposed from the base end of the bracket walls and parallel to the bracket walls, the at least one guide/lateral support flange sized and placed on the floating wall bracket so as to act as a guide to placing the floating wall bracket on the floating base plate member and so as to provide additional lateral support for the vertical member attached to the floating base plate member via the floating wall bracket.

An embodiment of the present invention may further comprise a method for constructing a floating wall using floating wall brackets comprising: attaching a plurality of floating wall brackets to a floating base plate member; placing one end of a vertical member from a plurality of vertical members into an opening of each of the plurality of floating wall brackets such that each of the plurality of vertical members placed into each of the plurality of floating wall brackets is substantially perpendicular to the floating base plate member and is held in place in each of the plurality of floating wall brackets by at least one friction means of each of the floating wall brackets such that a desired float space between the end of each of the vertical members and the floating base plate member is established; attaching the other end of each of the vertical members to a non-floating plate member to create a floating wall assembly; leveling the floating wall assembly by adjusting placement of each of the plurality vertical members in each of the plurality of floating wall brackets; and installing the floating wall assembly between a floating slab and at least one next level up floor joist.

An embodiment of the present invention may further comprise the method of the previous paragraph further comprising: rotating the floating base plate member attached with the plurality of floating wall brackets substantially ninety degrees such that the vertical members are placed in the floating wall brackets horizontally rather than vertically and the non-floating plate member is attached in the horizontal position; and rotating the floating wall assembly from the horizontal position substantially ninety degrees to a substantially vertical position for leveling and installing of the floating wall assembly.

DETAILED DESCRIPTION OF THE EMBODIMENTS

To address problems with building on expansive/swelling soils, construction may use both caissons and floating slabs. Caissons are concrete formations that are typically poured or driven deep into the ground until the concrete reaches bedrock, which is below the expansive soils. The foundation of a structure may then be constructed on-top of the bedrock supported caissons. Since the foundation rests on the bedrock by way of the caisson formation, the foundation will not experience vertical expansion/contraction forces from expansive soils. For example, concrete basement walls for a house may be poured in place, on-top of caissons when building the house on expansive soils. The floor of the structure may then be poured over the expansive soil as a separate piece, not connected to the foundation walls or caissons. Therefore, the floor or concrete slab may be considered a separate "floating" formation, which may be actually intended to rise when the soil expands/swells and lower when the soil contracts. This separate floating concrete formation may be considered a floating floor or floating slab.

The primary or above grade structure may be built securely on the foundation walls, which rest on bedrock. The floors constructed on the foundation walls are fixed and will not move from the expansive soil. The distance between an upper level floor (which is the floor in the room above and the ceiling in the room below) and the floating slab decreases when the soil expands moving the floating slab up and increases when the soil contracts, moving the floating slab down. Since the floating slab moves up and down, decreasing and increasing the distance between the floating slab and the ceiling (aka. the floor of the upper room), care must be taken when constructing walls that span between the floating slab and the ceiling above. In order to prevent damage to the walls spanning between the floating slab and the ceiling, the walls necessarily may also be built with mechanisms that allow the walls to "float" with respect to the floating slab movement. Generally, when speaking of "float" herein, it is intended to mean the vertical up and down movement of a floating slab and/or the floating wall attached to the floating slab in relation to the fixed foundation caissons/pillars and above grade structure built on the fixed foundation caissons/pillars.

Figure 1:
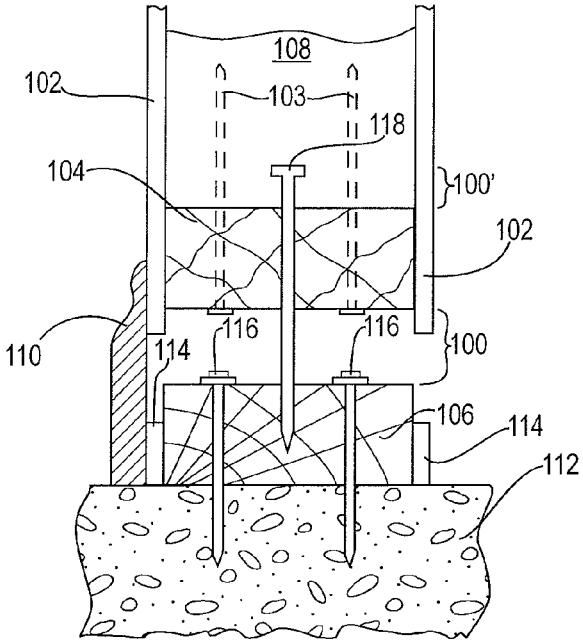
FIG. 1 is schematic illustration of an elevation section view through a floating wall that utilizes typical construction techniques with a bottom plate.

FIG. 1 is schematic illustration of an elevation section view through a floating wall that utilizes typical construction techniques with a bottom plate 106. A floating wall may be built as shown in FIG. 1. In FIG. 1, the base plate 106, bottom plate 104, and the vertical board (also may be reference as the stud) 108 that span between the floating slab 112 and the ceiling (not shown). When building a floating wall, as shown in FIG. 1, the vertical studs 108 may be fastened to both a top plate (attached to the ceiling and not shown) and the bottom plate 104 with nails 103. Prior to assembling the vertical studs 108 to the bottom plate 104, holes are drilled into bottom plate 104 in order to accommodate long nails or spikes 118 that may be driven down through the bottom plate 104 into the base plate 106 after the assembled wall is fastened to the ceiling. The distance of travel 100 between the bottom plate 104 and the base plate 106 provides for the floating space 100 (plus 100') that the wall may travel. In some building codes, an additional floating space 100' is required by leaving space between the head of the nail/spike 118 and the bottom plate 104 such that the floating wall may also travel up to the head of the nail/spike 118 without the additional friction/interference of the head of the nail/spike 118. A typical building code may require an inch and a half of float for float spaces 100 and 100', but the exact amount of float provided may be changed with changes/updates to building laws, or to the additional preference of the builder. The base plate 106 may be fastened to the floating slab 112 with concrete nails 116 or similar type functionality for a fastener such as a fastener from Ramset Fastening Systems.

Using typical construction techniques, the floating wall is constructed by fastening the vertical studs 108 to both the top plate (not shown) and the bottom plate 104 with nails 103. After the floating wall is assembled horizontally on the floor, the floating wall may then be lifted up by the builder or builders to a vertical position and temporarily rested on the base plate 106. Generally, it requires two or more people to lift the floating wall assembly up and/or the use of levers to lift the wall assembly up so that the top plate is flush with the floor joists (for the next level up) in the ceiling. While holding the wall up, the top plate (not shown) may be fastened to the ceiling floor joists with nails. However, before fastening, the floating wall assembly should be leveled and then held in a level position. Once the floating wall assembly is leveled, fasteners or nails may be used, typically from an air nail gun, to fasten the top plate to the floor joists in of the next level up. Leveling the floating wall assembly, holding the floating wall assembly in a level position and fastening the top plate to the ceiling floor joists (of the next level up) may be quite difficult for a single person, especially if the floating wall section is large. The act of lifting, balancing, leveling, and fastening the floating wall assembly to the floor joists of the next level up may require great strength and skill for a single person. If a single person cannot properly install the floating wall assembly, multiple people may be required to properly fasten a level floating wall to the floor joists of the next level up, especially when constructing large floating wall sections.

Once the floating wall is fastened to the ceiling floor joists of the next level up, the nails or spikes 118 may be driven through pre-drilled holes (having a diameter smaller than the spike to ensure that there is some friction resistance provided by the nails/spikes 118) in the bottom plate 104 and into the base plate 106. The nail/spike 118 will then move up or down through the hole in the bottom plate 104 as the base plate 106 moves up or down from swelling or contracting soil under the floating concrete slab 112, but there will be sufficient resistance provided by nail/spike 118 to hold the floating wall assembly up while the floating wall assembly is attached to the floor joists of the next level up. After the floating wall assembly is constructed and installed, finishing materials, such as drywall 102 and trim 110 may be added to hide the float 100 provided by the floating wall and make the floating wall appear like any other wall. Notably, the trim 110 should be attached to the floating slab 112 or base plate 106 and not to floating wall assembly (drywall 102, bottom plate 104, or any vertical studs 108) in order to ensure that the trim 110 does not exert the expansion/contraction forces from the expansive soil onto the floating wall. Optionally, spacing materials 114 may be added between the base plate 106 and the trim 110 so that the trim 110 is flush with both the base plate 106 and the drywall 102 of the floating wall. As shown in FIG. 1, the base plate 106 may be allowed to move up or down (i.e., float) without causing damage to the, bottom plate 104, vertical studs/members 108, drywall 102, or baseboard trim 110, or other finishing material attached to the floating wall.

As described above, the floating wall assembly clearly does not provide a supporting structure for a building, particularly for the floors above the floating wall and a floating wall is not a vertical supporting structure. Thus, floating walls are not proper for building of load bearing/supporting walls. Since the ceiling floor joists (of the next level up) are built on the foundation, there is no need for additional vertical support from the floating wall. Typical local building codes allow the non-load bearing walls to be built with this method, which results in no vertical support, and in certain areas, building codes may actually require the use of floating walls in non-loading bearing walls attached to a floating slab 112. The floating construction method shown in FIG. 1 does offer some lateral support through the nails or spikes 118 that are driven down through holes in the bottom plate 104 and into the base plate 1066. The nails may be allowed to slide up or down through the bottom plate 104, but the nails/spikes 118 may resist movement from forces perpendicular to vertical studs 108.

Figure 2:
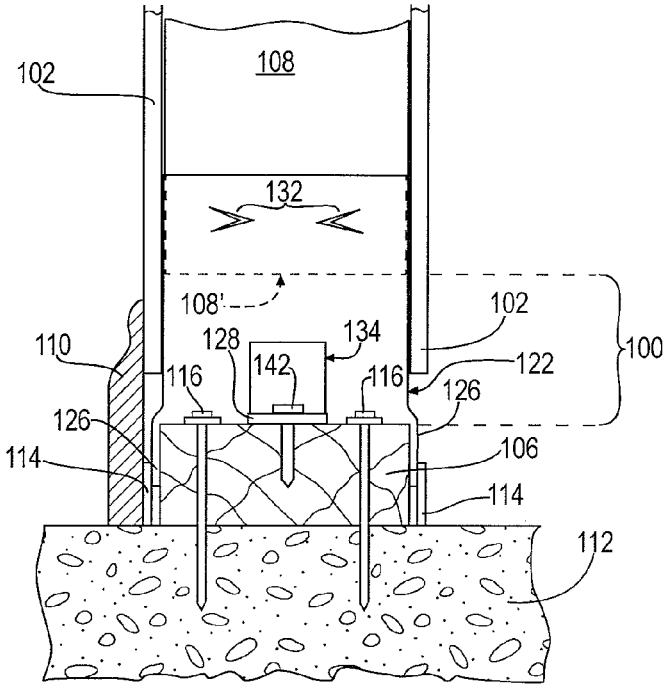
FIG. 2 is schematic illustration of an elevation section view through a floating wall constructed using a floating wall bracket embodiment.

FIG. 2 is schematic illustration of an elevation section view through a floating wall constructed using a floating wall bracket embodiment 122. For the embodiment shown in FIG. 2, may be more simply constructed using one or more floating wall brackets 122 without the need for a bottom plate member 104. A floating wall bracket 122 provides a user with a simple and effective means for constructing and hanging a floating wall by a single person. The floating wall bracket 122 may be manufactured from a single piece of material with few manufacturing steps. The floating wall bracket 122, which may be constructed as a rectangular channel with alignment flanges 126 and fastening tabs 128, secures vertical wall studs 108 to a floating base plate member 106 of a floating wall assembly. Both lateral support and ease of wall assembly may be achieved with using floating wall brackets 122. Using a set of floating wall brackets 122, one bracket 122 for each vertical stud 108 or combination of studs 108, a builder may construct an entire floating wall horizontally, on the floor, and then raise the wall into position for leveling and fastening to both the ceiling and floor. The floating wall brackets 122 may enable a single person to quickly complete the assembly and leveling of a floating wall in the final position of the floating wall before fastening the floating wall in place. As a result, the total time required and the total manpower required to construct the floating wall may be reduced, which may reduce total labor costs. Please note, one skilled in the art will recognize that the terms "flange" and "tab" may be interchanged and mean substantially the same physical structure, but herein to differentiate the alignment flange 106 from the fastening tab 128, the term "flange" will generally be used for the alignment flange 106 and the term "tab" will generally be used for the fastening tab 128. Other than to provide clarity, no particular meaning is intended by the chosen "flange" and "tab" syntax.

Multiple floating wall brackets 122 may be used by a builder to construct a complete floating wall. The installer/builder may first measure and mark out locations for each of the vertical studs 108 on both the top plate/non-floating plate member (not shown) and the floating base plate 106. Again, the bottom plate member 104 shown in the construction of the FIG. 1 floating wall is not used when constructing a floating wall with floating wall brackets 122. At each marked vertical stud 108 location, a floating wall bracket 122 may be set on the floating base plate member 106 such that the floating wall bracket base 129 may be flush with the floating base plate member 106 (see also, the embodiment shown in FIG. 5). The alignment/lateral support flanges 126 may slide downward along the sides of the floating base plate 106. The floating wall bracket 122 may then be fastened to the floating base plate 106 at each of the fastening tabs 128 using hanger nail 142 or other types of fastener/attachment means. One floating wall bracket 122 may be fastened to the floating base plate member 106 for each vertical stud 108 or pair of studs 108.

After fastening all of the floating wall brackets 122 to the floating base plate member 1066, the floating wall assembly may optionally be tipped ninety degrees so the rectangular opening 124 (see, for example FIG. 3) is parallel with the floor. While tipping the assembly over to perform some construction tasks may make construction easier, it is not required. If a user prefers to build the floating wall when the wall is substantially vertical, or at any other angle, the floating wall brackets 122 still provide significant stability benefits for non-horizontal construction. The vertical studs 108 may be fastened to the top/non-floating plate member (not shown). Each of the vertical studs 108 may then be aligned with the rectangular opening 124 of a corresponding floating wall bracket 122. The vertical studs 108 may then be driven into the rectangular opening 124 of the floating wall brackets 122 by hammering the top/non-floating plate member towards the floating base plate 1066 while the entire floating wall assembly is lying horizontally on the floor (or in whatever position is desired by the builder). The scoring tabs 132 that protrude towards the center of the rectangular opening 124 create resistance by scoring or cutting into the vertical studs 1088 as they are hammered into the floating wall bracket 122. The installer/builder may continue to hammer the vertical studs 108 into the floating wall brackets 122 until the base 108' of the vertical stud 1088 just appears in the depth viewing window 136 (see, for example FIG. 3).

Figure 5:
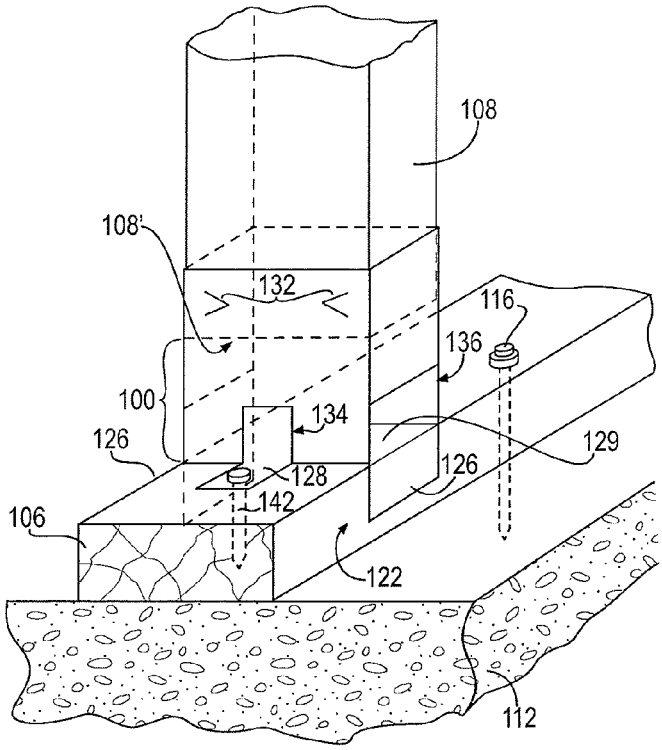
FIG. 5 is a schematic illustration of perspective view of a floating wall bracket embodiment connecting a vertical stud to a base plate.

Once all of the vertical wall studs 108 are at the proper depth in the floating wall brackets 122, the floating wall assembly may then be lifted ninety degrees back to a substantially vertical position. If the builder chose not to build the floating wall assembly in the horizontal position, the floating wall assembly may be moved however necessary to bring the wall to being substantially vertical, including doing nothing if the floating wall assembly was built in a substantially vertical position. In the vertical position, the floating base plate member 106 may be flush on the floating slab 112, as is also shown in FIG. 5, and the top/non-floating plate member (not shown) may be flush against the ceiling floor joists of the next level up. The friction means scoring tabs 132 may provide resistance to downward forces from the vertical studs 1088, resulting in an assembled floating wall that stays flush with the ceiling floor joists of the next level up without requiring the installer/builder to lift and balance the floating wall assembly. The installer/builder may then tap the top/non-floating plate member (not shown) and the floating base plate member 106 into the final locations and ensure that the floating wall is plumb (i.e., level). Once plumb, the top/non-floating plate member may be fastened to one or more of the ceiling floor joists of the next level up, and the floating base plate member 106 may be anchored/fastened to the floating slab 112 with concrete nails 116 or a similar type of fastener from Ramset Fastening Systems as well as any other acceptable means of attaching the floating base plate member 106 to the floating slab 112.

Figure 3:
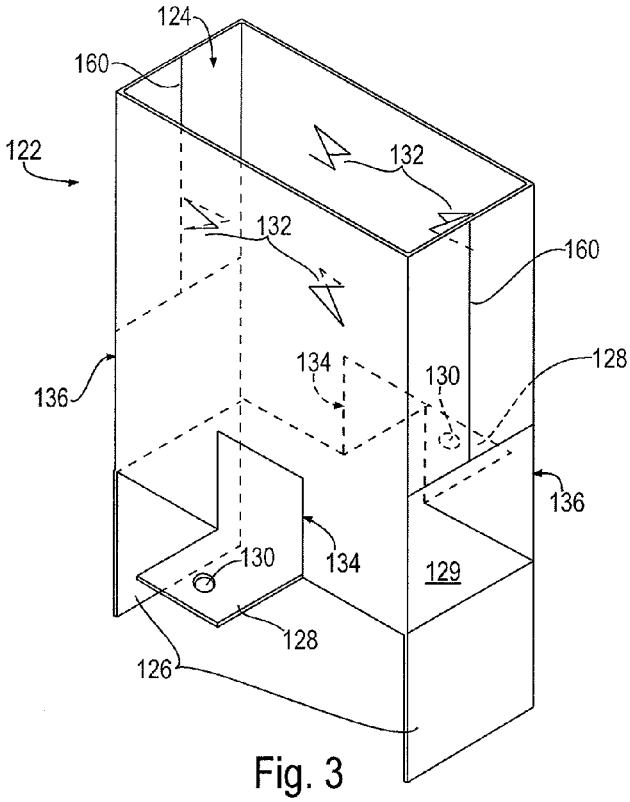
FIG. 3 is a schematic illustration of a perspective view of a floating wall bracket embodiment.

After the floating wall assembly is complete, the amount of float space 100 available may be measured as the distance between the bottom 108' of the vertical studs 108 and the bracket base 129 (see, for example FIG. 3). Over time, as the floating slab 112 rises from swelling soils beneath, the base plate 106 may rise overcoming the resistance/friction between the friction means scoring tabs 132 and the vertical studs 108, forcing the floating wall bracket 122 to slip upward on the vertical stud 108. If the soil contracts, the floating wall bracket 122 may slip downward along the vertical stud 108, again overcoming the resistance/friction between the friction means scoring tabs 132 and the vertical studs 108. If a side of the floating wall is not covered with finishing material (such as drywall 102), the depth windows 136 (see, for example FIG. 3) may be used to provide a visual indication of the remaining amount of float 100. Again, the floating wall assembly does not provide a supporting structure for a building, particularly for the floors above the floating wall despite the additional lateral support provided by the floating wall brackets 122, and, accordingly, a floating wall is still not a vertical supporting structure. Thus again, floating walls are not proper for building of load bearing/supporting walls. And again, since the ceiling floor joists (of the next level up) are built on the foundation, there is no need for additional vertical support from the floating wall. Again, typical local building codes allow the non-load bearing walls to be built with this method, which results in no vertical support, and in certain areas, building codes may actually require the use of floating walls in non-loading bearing walls attached to a floating slab 112.

In the same manner as for the floating wall construction technique described above in the disclosure with respect to FIG. 1, once the floating wall assembly is fastened to the ceiling floor joists of the next level up, finishing materials, such as drywall 102 and trim 110 may be added to hide the float 100 provided by the floating wall and make the floating wall appear like any other wall. Notably, the trim 110 should be attached to the floating slab 112 or base plate 106 and not to floating wall assembly (drywall 102 or directly into any vertical members 108) to ensure that the trim 110 does not exert the expansion/contraction forces from the expansive soil onto the floating wall. Optionally, spacing materials 114 may be added between the base plate 106 and the trim 110 so that the trim 110 is flush with both the base plate 106 and the drywall 102 of the floating wall. As shown in FIG. 2, the vertical members 108 may be allowed to move up or down (i.e., float) without causing damage to the, floating bottom plate member 104, vertical studs/members 108, drywall 102, or baseboard trim 110, or other finishing material attached to the floating wall.

Figure 4:
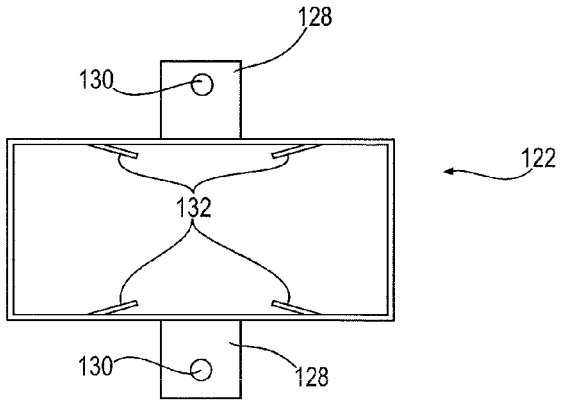
FIG. 4 is a schematic illustration of top view of a floating wall bracket embodiment.

FIG. 3 is a schematic illustration of a perspective view of a floating wall bracket 122 embodiment. FIG. 4 is a schematic illustration of top view of a floating wall bracket embodiment 122 similar to the floating wall bracket embodiment 122 of FIG. 3. The floating wall bracket embodiments 122 shown in FIG. 3 and FIG. 4 are also similar to the floating wall bracket 122 embodiment disclosed above with respect to FIG. 2. The floating wall bracket 122 may be constructed of material providing sufficient structural integrity to satisfy local building codes for floating wall construction. Some of the potential materials of construction for the floating wall bracket 122 include, but are not limited to: at least one manufacturing pattern metal piece cut/stamped from flat-rolled/sheet metal, PVC (PolyVinyl Chloride), plastic, molded plastic, casted/molded metal, and/or any other material or combination of materials with satisfactory strength and rigidity. In some embodiments, the floating wall bracket 122 may be made from a homogenous (single type) piece of material in order to reduce the complexity of manufacture of the floating wall bracket 122.

The floating wall bracket embodiment of FIGS. 3 and 4 has a rectangular opening 124 at the top of the floating wall bracket 122 sized. In the floating wall bracket embodiment of FIGS. 3 and 4, the opening 124 is sized for insertion of a common building material board or vertical stud of 2×4 inches. Other embodiments may size opening 124 for other common board/vertical stud sizes such as, but not limited to: 2×6 inch boards, 2×8 inch boards, 4×4 inch boards, two back to back 2×4 inch boards (essentially a 4×4 board) (see, for example the embodiments disclosed with respect to FIGS. 5, 8, and 9 below). Further, the opening 124 of the bracket 122 walls may be sized such that the perimeter of the bracket 122 walls fit the cross-section perimeter of virtually any shape of a vertical member. For example, the floating wall bracket may be sized to fit, but is not limited to, the following shapes: rectangle, square, triangle, circle, oval, other standard geometric shapes, and irregular/non-geometric shapes. While non-rectangular shapes may not be common for floating wall building materials, one skilled in the art will recognize that the use of a floating wall bracket 122 is not limited to rectangular shaped vertical members. In the embodiments of a floating wall bracket 122 shown in FIGS. 3 and 4, there are multiple friction means scoring tabs 132 that protrude towards the center of the rectangular opening 124 to provide friction to support the weight of a vertical member placed within the floating wall bracket 122. As is also described in the disclosure with respect to some example alternate embodiments below, other friction means 132 may be incorporated into a floating wall bracket 122 embodiment. Various embodiments may incorporate one or more friction means 132. Depending on the type of friction means, evenly placing a plurality of friction means within the floating wall bracket 122 may provide a benefit of distributing the friction load over a larger area as well as providing redundancy in case one or more of the friction means 132 do not provide the desired friction/resistance. The totality of the frictions means 132 should provide enough friction to hold the weight of a vertical member held within the floating wall bracket 122 without the vertical member freely moving within the walls of the floating wall bracket 122 and such that the vertical member will slide within the floating wall bracket 122 walls once a floating wall assembly comprised of at least one floating wall bracket 122 is attached to floor joists of an upper level. The at least one friction means 132 incorporated within the floating wall bracket 122 should also be located on the floating wall bracket 122 such that the vertical member will have a desired amount of floating space between an end of the vertical member and the floating base plate member abutting the floating wall bracket at the base end 129 of the floating wall bracket 122 walls. In other words the at least one friction means should provide sufficient friction to oppose the weight of the floating wall during the period of time the floating wall is being installed, and/or the at least one friction means should be constructed with a material(s) and in a manner that provides sufficient resistance to typical floating wall lateral forces and that meets local building codes, which may be comparable to that achieved with a 60 D spike/nail, (which is commonly used in typical floating wall construction). Some example friction means 132 includes, but is not limited to: a score tab 132 on the bracket 122 wall, a scoring spike on the bracket 122 wall, a scoring device (such as tab 132) on the bracket 122 wall, a button indentation on the bracket 122 wall (see, for example FIGS. 14-16), a spike disposed vertically extending upward within the bracket 122 walls from the base end 129 of the bracket 122 walls towards the vertical member (see, for example FIG. 10), and a fastener slot opening on the bracket wall having fasteners attached to the vertical member through the fastener slot opening (see, for example FIGS. 11, 12, 17 and 18).

The floating wall bracket 122 embodiment shown in FIGS. 3 and 4 has fastening tabs 128 on each side of the floating wall bracket 122, which are perpendicular to the depth viewing windows 136 of the floating wall bracket 122. The fastening tabs 128 have fastening holes 130 in/through each of the fastening tabs 128 such that a nail, screw, bolt, rivet, or other appropriate fastening device that may use a hole through the fastening tab 128 to attach the fastening tab to a floating base plate member. Any attachment means that substantially attaches the fastening tabs 128 of the floating wall bracket 122 to the floating base plate member may be used to attach the fastening tabs 128 to the floating base plate member. Some example attachment means for the fastener tabs may include, but are not limited to: at least one hole 130 for permitting at least one nail to be driven into the floating base plate member through the fastening tab 128, at least one hole 130 for permitting at least one screw/bolt to be screwed into/attached to the floating base plate member through the fastening tab 128, at least one hole 130 for permitting at least one rivet to be attached to the floating base plate member through the fastening tab 128, glue, double sided tape, and other adhesive materials.

While other features may provide highly desirable features and additional functionality, a floating wall bracket 122 may provide the attachment and friction/resistance capabilities with bracket 122 walls that have a perimeter substantially in a shape of a cross-section of a vertical member that is to be placed into the floating wall bracket 122. The perimeter of the bracket walls 122 should be substantially sized such that the cross-section of the vertical member fits within the bracket 122 walls. The bracket 122 walls have an open end 124 for accepting the vertical member and a base end 129 that abuts the floating base plate member where the floating base plate member is disposed substantially perpendicular to the vertical member. Further, the bracket 122 walls should extend from the open end 122 toward the base end 129 such that the vertical member may securely fit within the bracket 122 walls and at least a portion of the bracket 122 walls should extend all the way to the base end 129. A floating wall bracket 122 should also have at least one fastening tab 128 disposed from the base end 129 of the bracket 122 walls and extending perpendicular to the bracket 122 walls such that the at least one fastening tab 128 may be aligned linearly with the floating base plate member. The at least one fastening tab 128 should also have at least one attachment means 130 for attaching the at least one fastening tab 128 of the floating wall bracket 122 to a floating base plate member. The embodiment shown in FIGS. 3 and 4 has two fastening tabs 128, but an embodiment with one fastening tab 128 may work, but may not be as stable or as easy to use. Additionally, a floating wall bracket 122 should have at least one friction means 132 incorporated into the floating wall bracket 122 that acts on a vertical member to support the vertical member within the floating wall bracket 122. The at least one friction means 132 should provide enough friction to hold the weight of the vertical member within the floating wall bracket without the vertical member moving freely within the bracket 122 walls. The at least one friction means 132 should also limit the friction provided such that the vertical member will slide within the bracket 122 once a floating wall assembly comprised of at least one floating wall bracket 122 is attached to floor joists of an upper level. The at least one friction means 132 should be incorporated within the floating wall bracket 122 such that the vertical member will have a desired amount of floating space between an end of the vertical member placed within the bracket walls of the floating wall bracket 122 and the floating base plate member at the base end 129 of the bracket walls. While not required for basic functionality of an embodiment, guide/lateral support flanges 126 provide highly desirable functionality of guiding a builder in placing a floating wall bracket 122 on a floating base plate member as well as proving additional lateral support for the floating wall assembly. In the embodiment shown in FIGS. 3 and 4, there are two guide/lateral support flanges 126, one on each side that does not have a fastening tab 128. The guide/lateral support flanges 126 extend downward below the base end 129 of the bracket 122 walls on the same side as a depth viewing windows 136. The depth viewing windows 136 on each side of the floating wall bracket 122 also provide desirable functionality of being able to view how deep a vertical member extends within the floating wall bracket 122. Openings 134 that are perpendicular to the fastening tabs 128 are a result of the fabrication of the particular floating wall bracket 122 embodiment shown in FIGS. 3 and 4, but may also be used to view a depth of the vertical member within the floating wall bracket 122. The seam 160 that runs vertically along the sides of the floating wall bracket on the same side as the depth viewing windows 136 is also a result of the fabrication of the particular floating wall bracket 122 embodiment shown in FIGS. 3 and 4. The seam may be attached by any reasonable means, such as, but not limited to a welding joint. The bracket 122 may also be manufactured without a weld at seam 160 by bending the sides to hook into one another and/or the bracket may be manufactured without a weld at seam 160 by punching/stamping/cutting the entire bracket from a single piece of material.

FIG. 5 is a schematic illustration of perspective view of a floating wall bracket 122 embodiment connecting a vertical stud 108 to a floating base plate member 106. As may be noted, the floating wall bracket 122 and the vertical member 108 shown in FIG. 5 appear to be square in shape/perimeter. As described above, FIG. 5 represents an alternate embodiment of a floating wall bracket 122, such as an embodiment designed to fit a 4×4 inch board or two 2×4 inch boards placed back to back together within the floating wall bracket 122. The floating wall bracket 122 may also be manufactured as a half piece (see for example FIGS. 13-16). The floating wall bracket 122 could be divided into two equal pieces, or pieces that are not equal, and then attached together to form the complete floating wall bracket 122. The floating wall builder may obtain a final floating wall bracket 122 assembly by placing the halves together, interlocking them with a tab or hook, and nailing the fastening holes 130 in each of the fastening tabs 128 to the floating base plate member. Various embodiments of the floating wall bracket 122 could also be manufactured through injection molding. Rather than making the floating wall bracket 122 out of a piece of metal, the bracket 122 could also be made out of a plastic material. Through standard injection modeling processes, the floating wall bracket 122, in any of its various forms, could be manufactured without any seams. The remaining functionality of the embodiment shown in FIG. 5 may be derived from the disclosure with respect to FIGS. 2-4 above with similar functionality for the same callout numbers.

Figure 6:
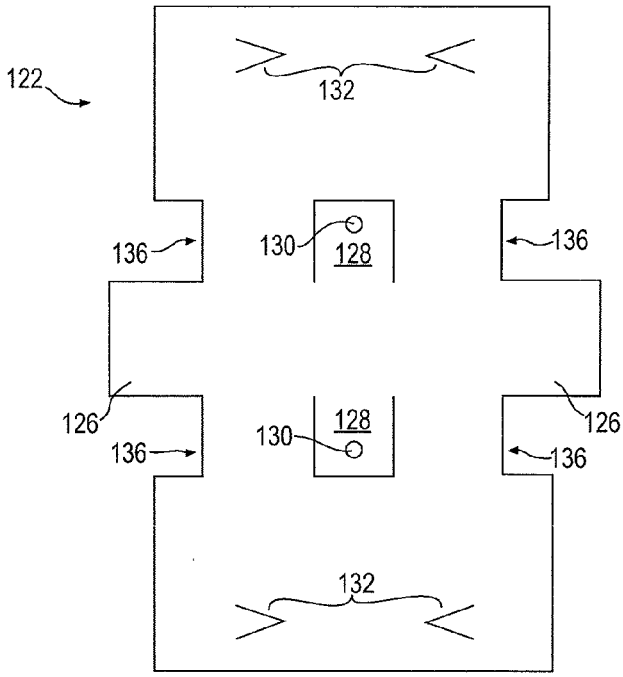
FIG. 6 is a schematic illustration of a manufacturing pattern for constructing a floating wall bracket embodiment from rolled or other flat plate material.
Figure 7:
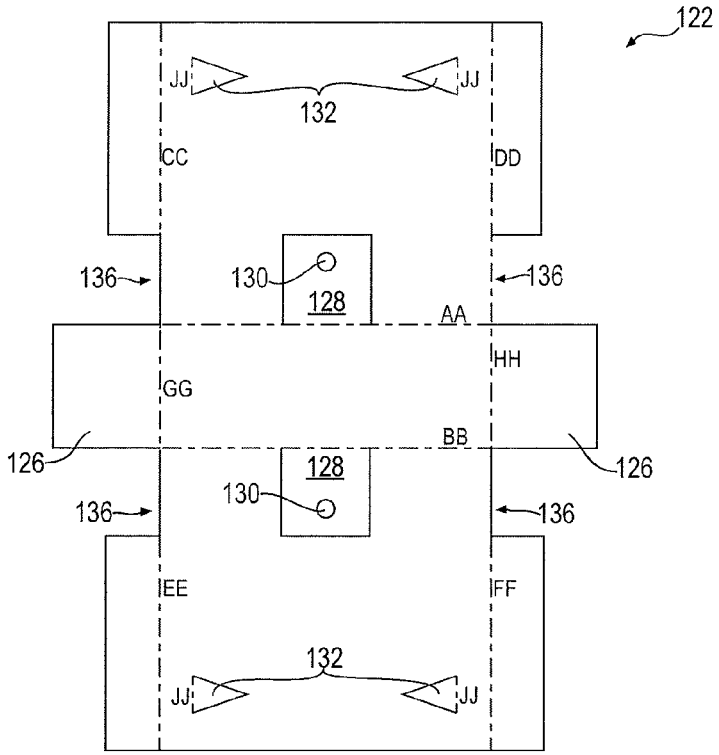
FIG. 7 is a schematic illustration of a manufacturing pattern for constructing a floating wall bracket embodiment from rolled or other flat plate material with indications where folds or bends are performed from the pattern to form the floating wall bracket embodiment.

FIG. 6 is a schematic illustration of a manufacturing pattern 122 for constructing a floating wall bracket 122 embodiment from rolled or other flat plate material. FIG. 7 is a schematic illustration of a manufacturing pattern 122 for constructing a floating wall bracket 122 embodiment from rolled or other flat plate material with indications where folds or bends (AA-JJ) are performed from the pattern 122 to form the floating wall bracket embodiment. The embodiment eventually created by the manufacturing pattern 122 shown in FIGS. 6 and 7 is similar to the floating wall bracket 122 embodiment disclosed with respect to FIGS. 2-5 above. The floating wall bracket 122 embodiment may be fabricated from a single piece of sheet metal using manufacturing pattern 122. The manufacturing pattern 122 shown in FIGS. 6 and 7 is a form that may be stamped from a single piece of sheet metal to form the floating wall bracket 122. After stamping the manufacturing form 122, which includes fastening holes 30 that can be punched out at the same time as the bracket form or drilled out as a secondary step, the final floating wall bracket form 122 is achieved by folding the stamped form 122. Note that friction means scoring tabs 132, fastening tabs 128, guide/lateral support flanges 126, and viewing window 136 are incorporated within the manufacturing form 122. As shown in FIG. 7, the flanges 126 are folded downward ninety degrees along fold lines HH and GG. The sides are folded ninety degrees upward along fold lines CC, DD, EE, and FF. The floating wall bracket 122 sides that include the scoring tabs 132 are folded upward ninety degrees along fold lines AA and BB. Each of the fastening tabs 128 are folded downward ninety degrees along fold lines AA and BB to keep the fastening tabs 128 flush with the bracket base 129. Finally, the sides that abut together are joined with a welding or other similar operation at seam 160, as shown in FIG. 3.

Figure 8:
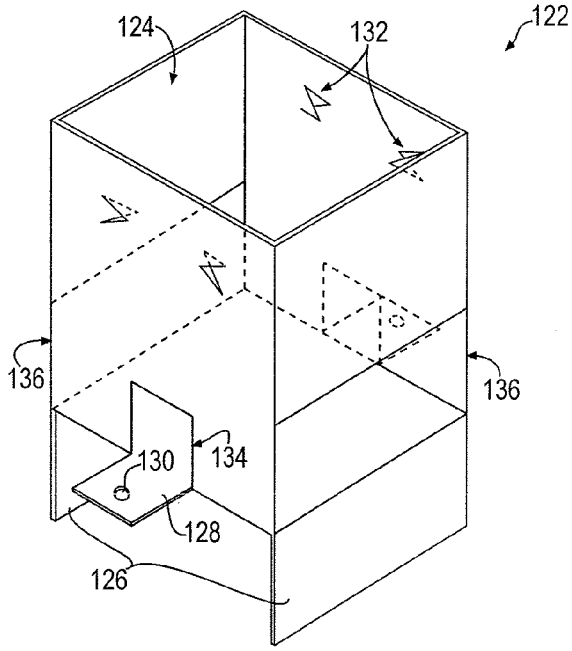
FIG. 8 is a schematic illustration of a perspective view of an alternate embodiment of a floating wall bracket that may hold two typical vertical studs.
Figure 9:
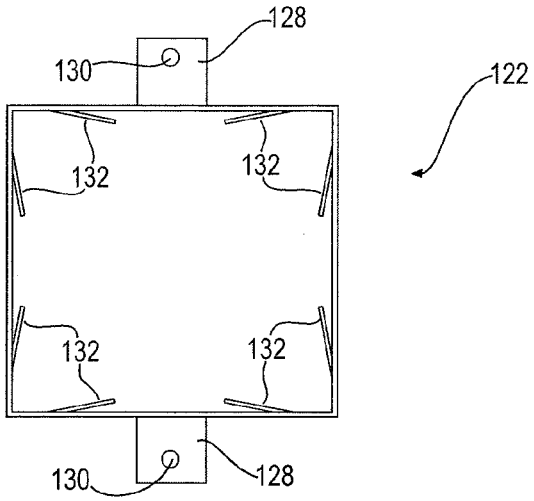
FIG. 9 is a schematic illustration of a top view of an alternate floating wall bracket embodiment that may hold two typical vertical studs.

FIG. 8 is a schematic illustration of a perspective view of an alternate embodiment of a floating wall bracket 122 that may hold two typical vertical studs. FIG. 9 is a schematic illustration of a top view of an alternate floating wall bracket 122 embodiment that may hold two typical vertical studs. As also described above in the disclosure with respect to FIG. 5, FIGS. 8 and 9 represent alternate embodiments of a floating wall bracket 122, such as an embodiment designed to fit two 2×4 inch boards placed back to back together within the floating wall bracket and/or a 4×4 inch board. The remaining functionality of the embodiment shown in FIG. 5 may be derived from the disclosure with respect to FIGS. 2-5 above with similar functionality for the same callout numbers.

Figure 10:
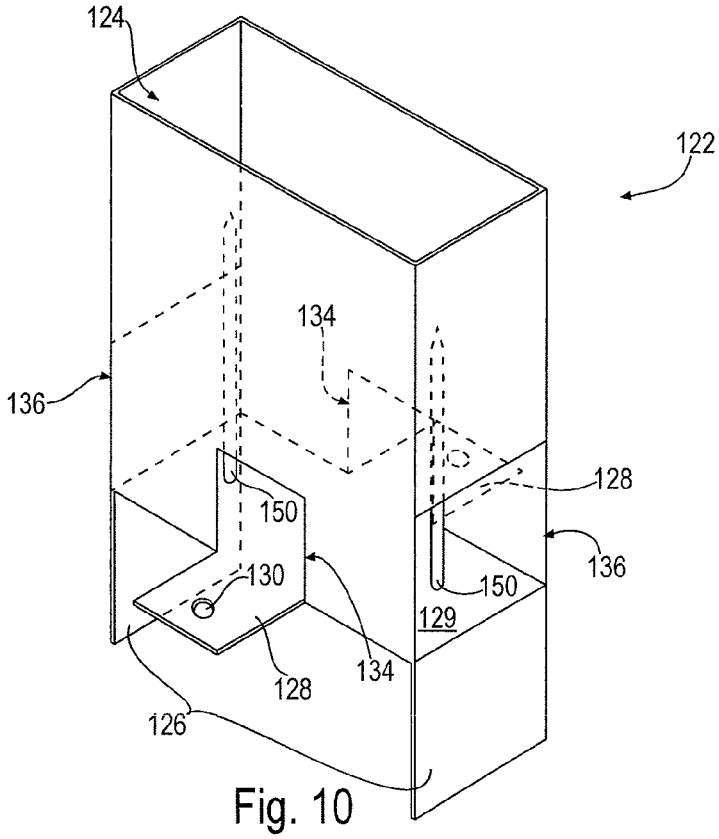
FIG. 10 is a schematic illustration of a perspective view of an alternate embodiment of a floating wall bracket with internal vertical spikes used as a friction mechanism.

FIG. 10 is a schematic illustration of a perspective view of an alternate embodiment of a floating wall bracket 122 with internal vertical spikes 150 used as a friction mechanism/means. The primary change for the embodiment shown in FIG. 10 is the use of two vertical spikes 150 to act as the friction means/mechanism rather than score tabs. For the embodiment shown in FIG. 10, the vertical member will slide up and down along spikes 150 in reaction to movement of the floating slab once the floating wall is installed. During construction of the floating wall vertical spikes 150 will act to hold the vertical member in place in a similar fashion as described for the score tabs in the disclosure with respect to FIGS. 2-5 above. The remaining functionality of the embodiment shown in FIG. 10 may be derived from the disclosure with respect to FIGS. 2-5 above with similar functionality for the same callout numbers.

Figure 11:
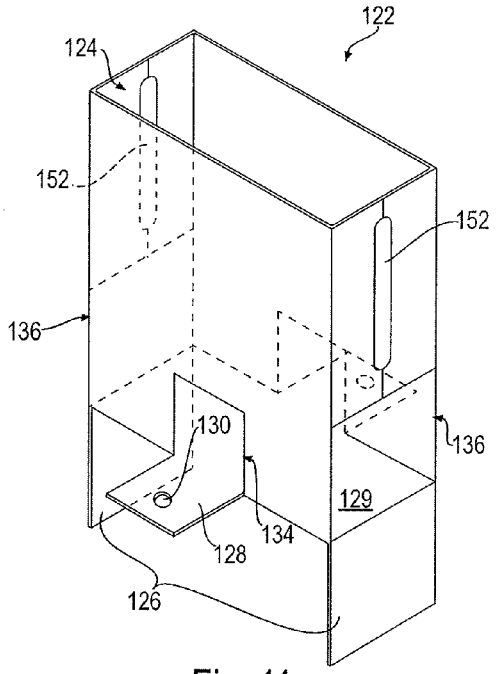
FIG. 11 is a schematic illustration of a perspective view of an alternate embodiment of a floating wall bracket with fastening slots on the side for providing a friction mechanism.

FIG. 11 is a schematic illustration of a perspective view of an alternate embodiment of a floating wall bracket with fastening slots 152 on the side for providing a friction mechanism. The primary change for the embodiment shown in FIG. 11 is the use of fastening slots 152 to act as the friction means/mechanism rather than score tabs. For the embodiment shown in FIG. 11, the fastening slots 152 are provided for inserting fasteners, such as screws or nails, into the vertical stud held in the floating wall bracket 122. The fasteners (e.g., screws or nails) may be inserted tightly enough to provide the desired friction, but not so tightly that too much friction is provided. The fastening slots 152 combined with the fasteners inserted in the fastening slots permits a builder to determine exactly how tight (i.e., how much friction) the builder wants the fastener attached to the vertical member. Further, the fastener may be removed once the hanging wall is installed since the wall will hang from the floor joists of the next level up. Thus, there may substantially no resistance for movement from soil expansion and contraction for the assembled wall. The remaining functionality of the embodiment shown in FIG. 11 may be derived from the disclosure with respect to FIGS. 2-5 above with similar functionality for the same callout numbers.

Figure 12:
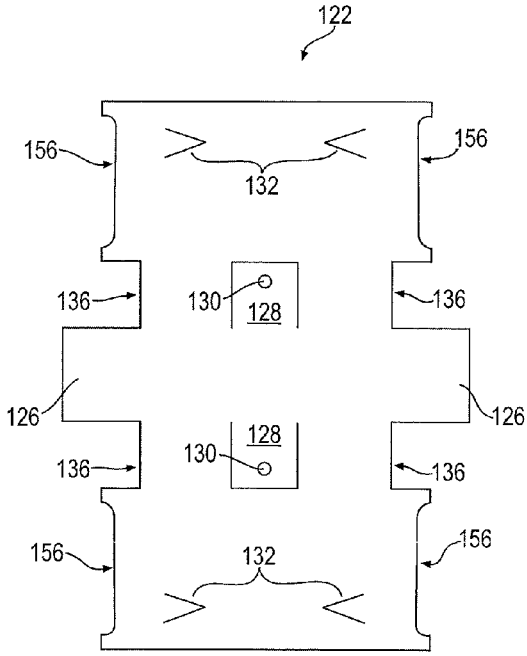
FIG. 12 is a schematic illustration of a manufacturing pattern for construction of an alternate floating wall bracket embodiment with fastening slots for providing a friction mechanism.

FIG. 12 is a schematic illustration of a manufacturing pattern 122 for construction of an alternate floating wall bracket 122 embodiment with fastening slots 152 for providing a friction mechanism. The functionality of the embodiment shown in FIG. 12 may be derived from the disclosure with respect to FIGS. 6-7 above with similar functionality for the same callout numbers. The additionally half cutouts 156 to achieve the fastening slots 152 of the fully fabricated floating wall bracket 122 is the primary difference for the embodiment of FIG. 12. Thus, the remaining functionality of the embodiment shown in FIG. 12 may be derived from the disclosure with respect to FIGS. 6 and 7 above with similar functionality for the same callout numbers.

Figure 13:
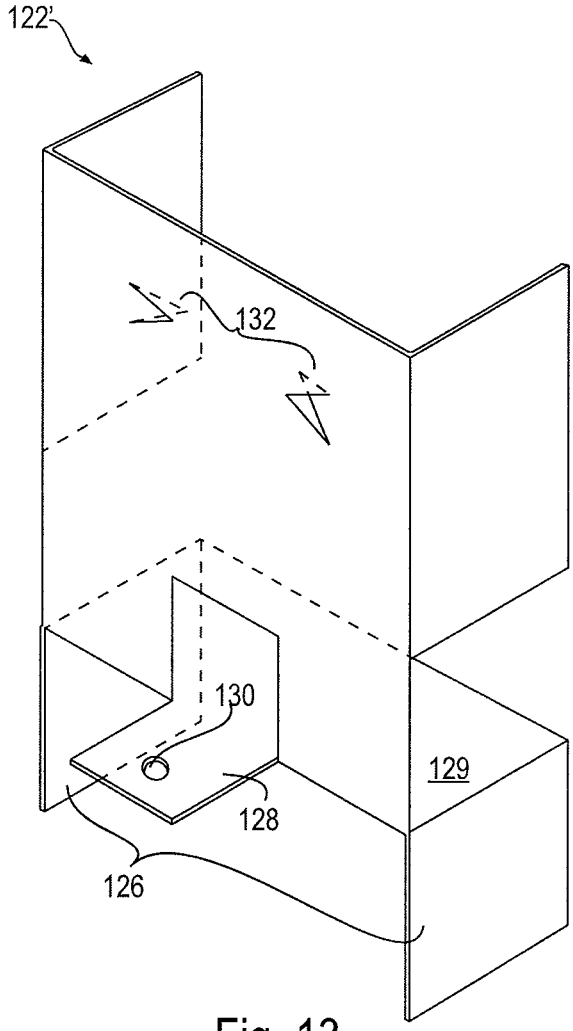
FIG. 13 is a schematic illustration of a perspective view of half of a floating wall bracket embodiment, which may be used as an alternative embodiment to manufacture a floating wall bracket embodiment.

FIG. 13 is a schematic illustration of a perspective view of half 122' of a floating wall bracket embodiment, which may be used as an alternative embodiment to manufacture a floating wall bracket embodiment. For the embodiment shown in FIG. 13, the functionality is substantially similar to the functionality disclosed above with respect to FIGS. 2-7, including having the same friction means scoring tabs 132. The primary difference is that the bracket is assembled from two separate pieces, separately stamped/cut out that may be assembled by welding along a seam as was done for seam 160, and/or to provide another attachment mechanism such as a hooks.

FIGS. 14-18 below are provided primarily to disclose additional embodiments in order to demonstrate the wide variety of embodiments that may implement the basic functionality of the floating wall bracket with bracket walls designed to fit a vertical member, fastening tabs to attach with an attachment means the fastening tabs of the floating wall bracket to a floating base plate member, at least one friction means incorporated into floating wall bracket, as well as other features such as guide/lateral support flanges and viewing windows. As one skilled in the art will recognize, many other embodiments may implement variants in size, shape, amount of friction, etc. for the various features of floating wall bracket embodiments. The various embodiments disclosed were chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

Figure 14:
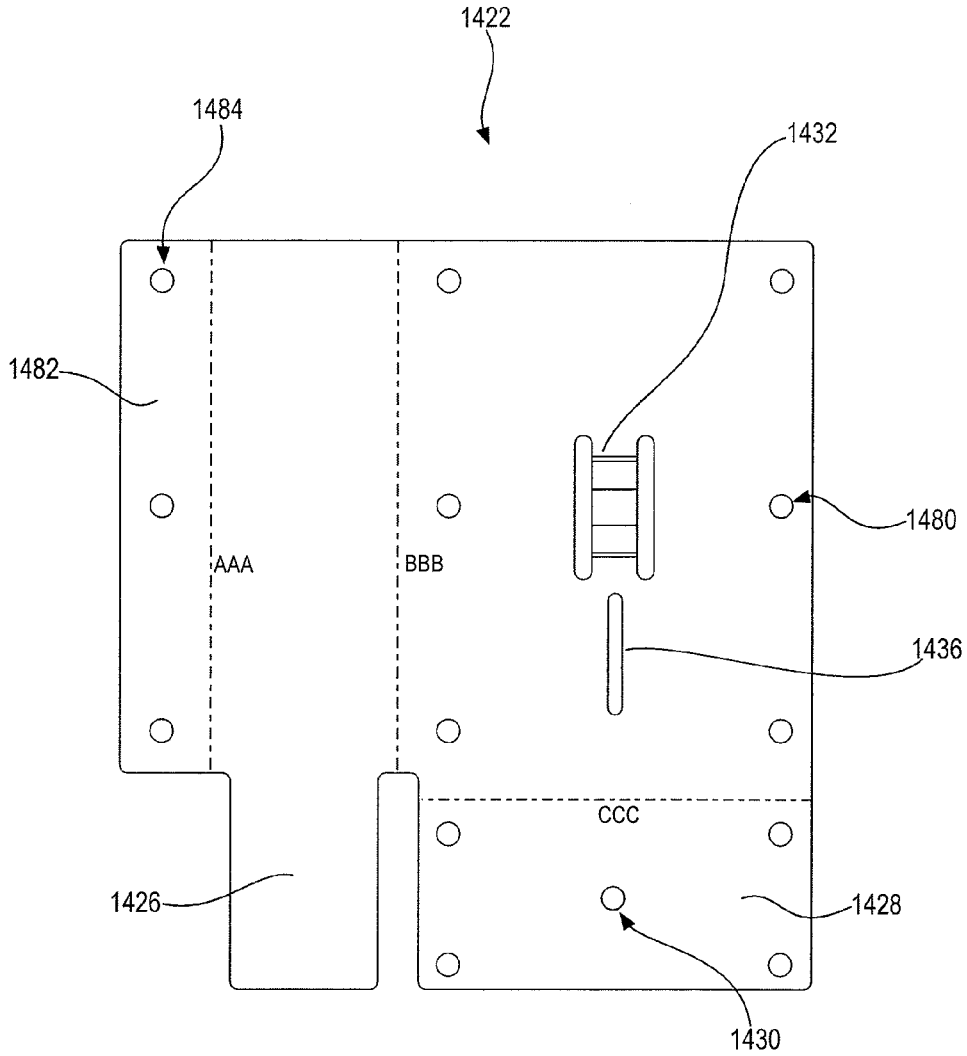
FIG. 14 is a schematic illustration of a manufacturing pattern for construction of half of another alternate floating wall bracket embodiment with button/indentations for providing a friction mechanism.
Figure 15:
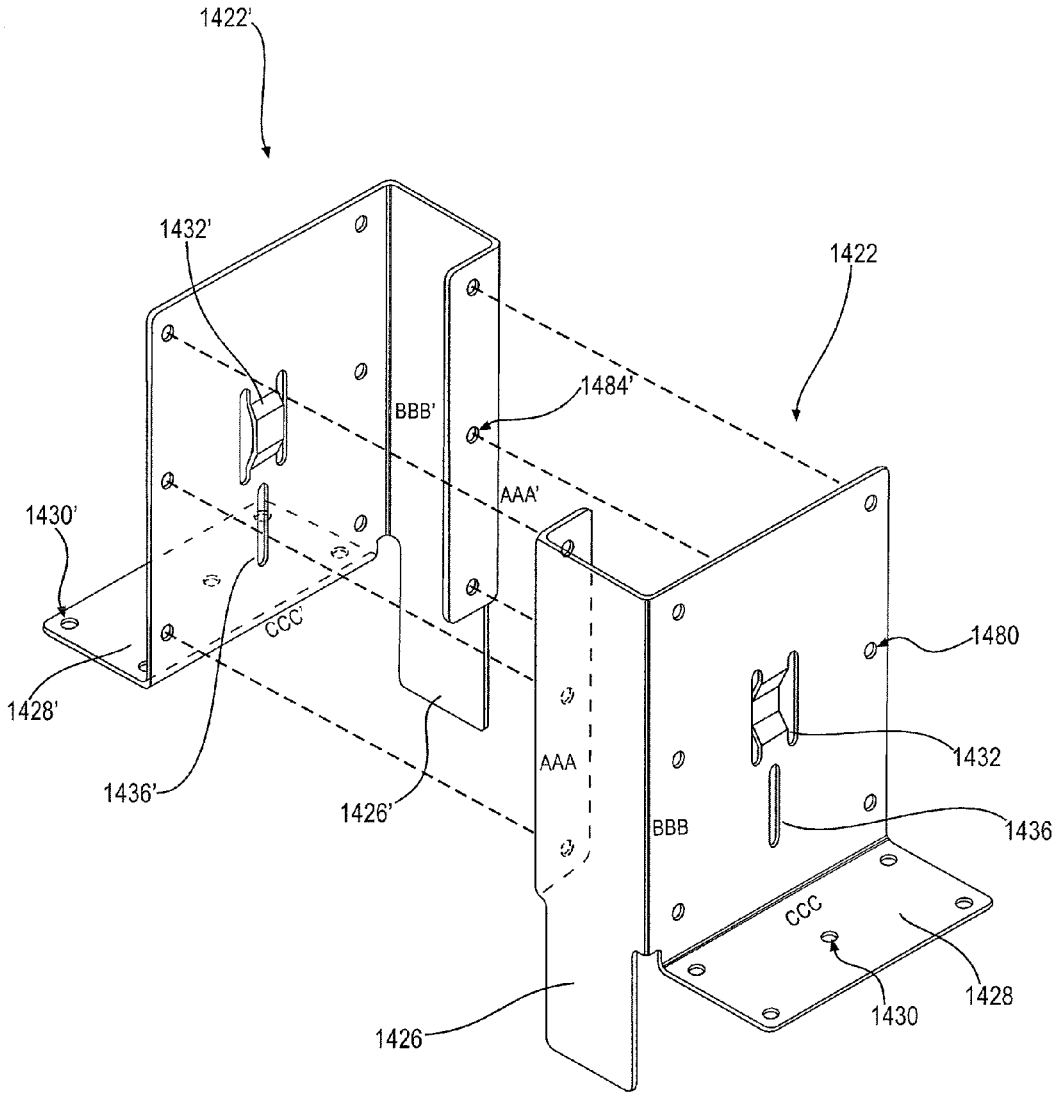
FIG. 15 is a schematic illustration of two halves of another alternate floating wall bracket embodiment with button/indentations for providing a friction mechanism being put together into a single floating wall bracket.
Figure 16:
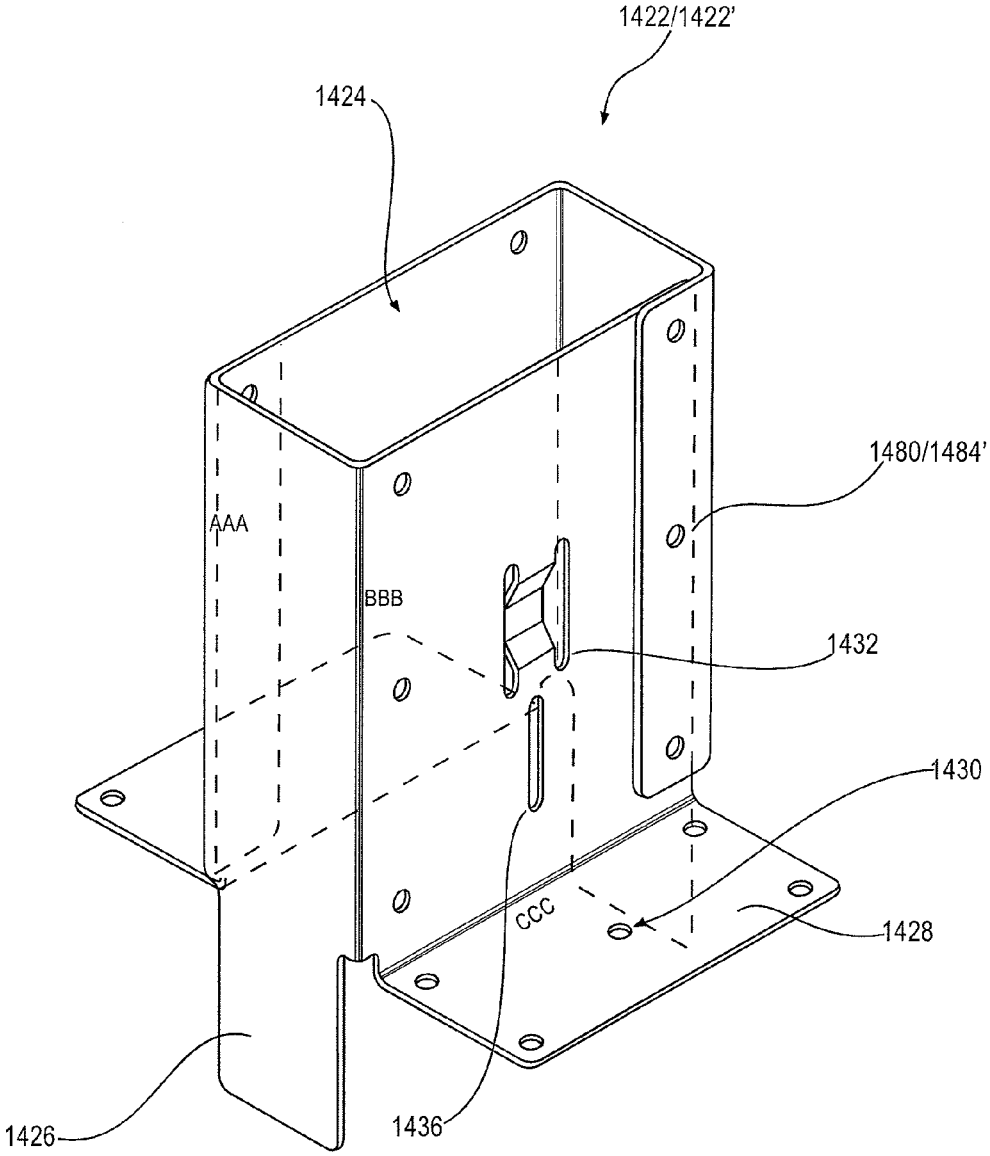
FIG. 16 is a schematic illustration of two halves of another alternate floating wall bracket embodiment with button/indentations for providing a friction mechanism completely put together into a single floating wall bracket.

FIG. 14 is a schematic illustration of a manufacturing pattern 1422 for construction of half of another alternate floating wall bracket embodiment with button/indentations 1432 for providing a friction mechanism. FIG. 15 is a schematic illustration of two halves 1422, 1422' of another alternate floating wall bracket 1422/1422' embodiment with button/indentations 1432/1432' for providing a friction mechanism being put together into a single floating wall bracket 1422/1422'. FIG. 16 is a schematic illustration of two halves 1422, 1422' of another alternate floating wall bracket 1422/1422' embodiment with button/indentations 1432/1432' for providing a friction mechanism completely put together into a single floating wall bracket 1422/1422'. FIGS. 14-16 taken together describe the manufacture of the floating wall bracket 1422/1422' embodiment from the manufacturing pattern 1422 of FIG. 14 to the marrying of the two bracket halves 1422, 1422' of FIG. 15 to the completed bracket 1422/1422' of FIG. 16. The manufacturing pattern 1422 is folded as shown in FIG. 15 along fold lines AAA, BBB and CCC. The three holes 1480 are matched up with the three holes 1484' on tab/flange 1482' and the three holes 1480' are matched up with the three holes 1484 on tab/flange 1482 such that half 1422 and half 1422' may be married/put together as shown in FIG. 16. The attachments at holes 1480/1484' and 1480'/1484 may be achieved by any acceptable attachment device such as the use of a rivet in each hole 1480/1484', 1480'/1484. Fastener tab 1428/1428' functions substantially similar to the fastener tabs 128 described above with respect to FIGS. 1-13 except that there are five attachment holes 1430/1430' rather than just one hole on each fastener tab 1428/1428'. Similarly the guide/lateral support flange 1426/1426' and the viewing window 1436/1436' also function substantially similar to the guide/lateral support flanges 128 and viewing windows 136 described above with respect to FIGS. 1-13. The indented button friction means 1432/1432' provides the desired friction, but in a different manner by relying on the flex/stiffness of the indented button 1432/1432' when a vertical member having a slightly larger perimeter where the indented button 1432/1432' is located is pushed past the indented button 1432/1432'.

Figure 17:
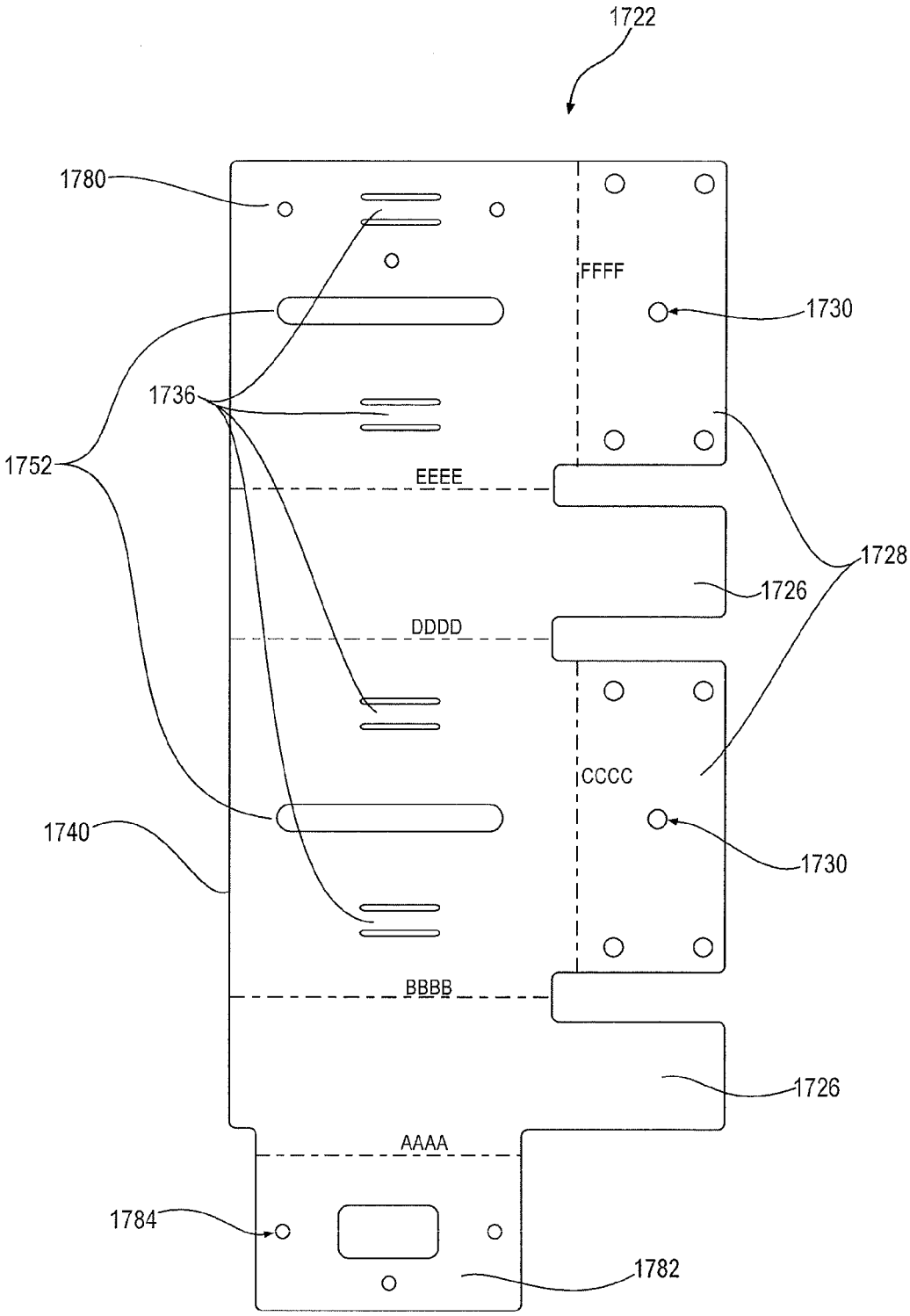
FIG. 17 is a schematic illustration of a manufacturing pattern for single piece construction of still another alternate floating wall bracket embodiment with fastening slots for providing a friction mechanism.
Figure 18:
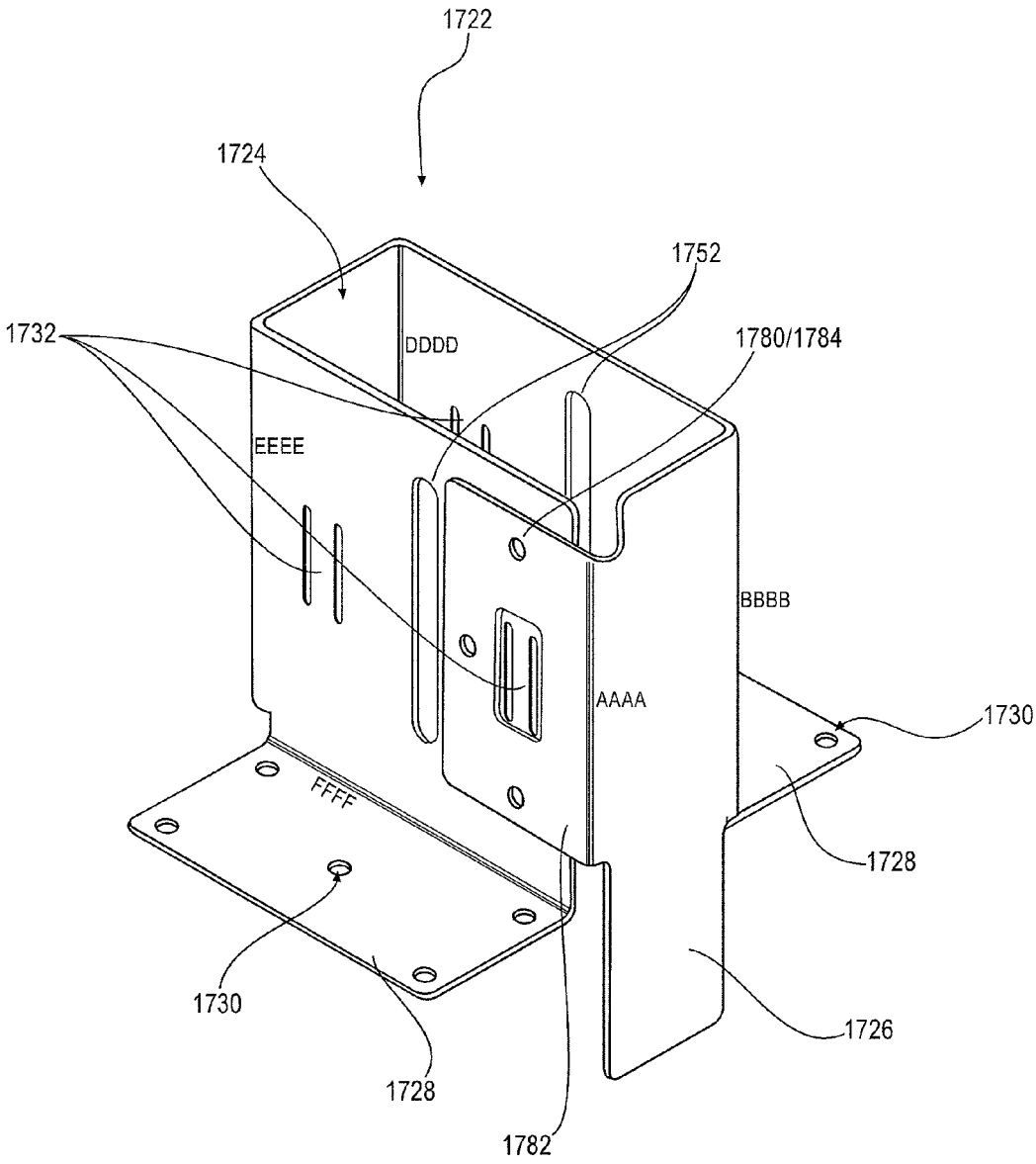
FIG. 18 is a schematic illustration of a complete single piece construction of still another alternate floating wall bracket embodiment with fastening slots for providing a friction mechanism.

FIG. 17 is a schematic illustration of a manufacturing pattern for single piece construction of still another alternate floating wall bracket 1722 embodiment with fastening slots 1752 for providing a friction mechanism. FIG. 18 is a schematic illustration of a complete single piece construction of still another alternate floating wall bracket 1722 embodiment with fastening slots 1752 for providing a friction mechanism. FIGS. 17 and 18 taken together describe the manufacture of the floating wall bracket 1722 embodiment from the manufacturing pattern 1722 of FIG. 17 to the completed bracket 1722 of FIG. 18. The manufacturing pattern 1722 is folded as shown in FIG. 18 along fold lines AAAA, BBBB, CCCC, DDDD, EEEE, and FFFF. The three holes 1780 are matched up with the three holes 1784 on tab/flange 1782. The attachments at holes 1780/1784 may be achieved by any acceptable attachment device such as the use of a rivet in each hole 1780/1784. Fastener tabs 1728 function substantially similar to the fastener tabs described above with respect to FIGS. 1-13 except that there are five attachment holes 1730 rather than just one hole on each fastener tab 1428. Similarly the guide/lateral support flanges 1726' and the viewing windows 1736 also function substantially similar to the guide/lateral support flanges and viewing windows described above with respect to FIGS. 1-13. The fastening slots 1752 friction means operate substantially similar to the expansion slots 152 of disclosed above in the disclosure with respect to FIG. 11 using the fastening slots 1752 and fasteners attached through the fastening slots 1752 to the bracketed vertical member.

The various embodiments provide a variety of benefits over the prior art. For instance, the various embodiments may provide a simple means for assembling a floating wall in comparison to the prior art. The various embodiments may make it possible for a single person to assemble a floating wall as well as provide a means to assemble an entire floating wall, including the base plate, vertical studs, and top plate, in a horizontal position prior to raising the wall to its vertical position for installation. The various embodiments may further support the floating wall in the vertical position, without lifting, while the builder levels the wall prior to fastening the top plate to the ceiling floor joists and/or provide increased resistance to lateral forces for the floating wall. The various embodiments may provide a window for viewing the position of the vertical stud in a floating wall bracket in order to assess the amount of vertical float remaining. Further, the various embodiments may reduce the time required to assemble a floating wall, reduce the total labor required to assemble a floating wall, reduce the amount of lumber required to assemble a floating wall by removing the need for a bottom plate, eliminate the need to pre-drill holes in the bottom plate for large nails or spikes, eliminate the need to measure and locate the relative positions for the pre-drilled spike holes and the stud locations in the bottom plate and the concrete nails in the base plate, and/or make it possible to secure the base plate to the concrete floor with concrete nails after the wall is leveled in place and fastened to the ceiling floor joists. The various embodiments may also attach easily to the base plate with common construction fasteners, provide a simple method for inserting and securing the vertical studs in the stud channel, provide a floating range that can be increased by increasing the manufactured depth of the bracket's stud/vertical member channel, and/or provide strength on walls with relatively short lengths (i.e., a short floating base plate member length).

In addition to the advantages of the floating wall bracket describe above, the manufacturing method of the bracket for the various embodiments may provide beneficial results because the bracket may be manufactured with a stud channel for a single stud or for multiple studs and/or for many additional vertical stud shapes, the bracket may manufactured using simple steps, the manufacture method is a low cost, the manufacture method may enable the bracket to be produced from a single piece of sheet metal, the manufacturing pattern of the bracket may be produced with a simple stamping operation or pressing operation, the final form of the bracket may be achieved from folding sections of a stamped manufacturing pattern, the manufacture method it is well suited for mass production, tooling may be developed to produce multiple brackets at one time, and only simple tooling changes are typically required to modify either the length of float provided or the quantity of studs the bracket may hold. Since the result from manufacturing is a single piece, it is also less expensive to store the bracket inventory and the installer doesn't has less worry about misplacing parts since there are fewer different parts involved.

Figure 19A:
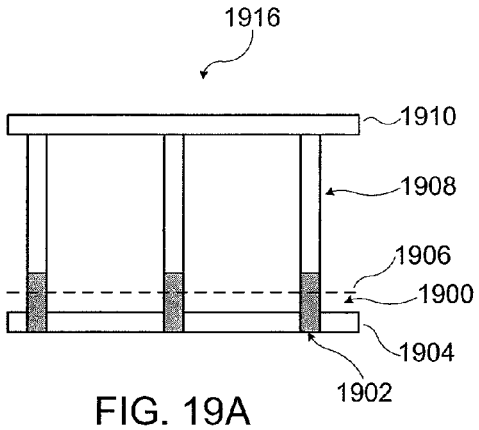
FIG. 19A is a schematic illustration of the traditional placement of floating wall brackets at the base of a floating wall assembly.

FIGS. 19A-D show various locations that the "float" 1900 may be located in a floating wall assembly 1916. FIG. 19A is a schematic illustration of the traditional placement of floating wall brackets 1902 at the base of a floating wall assembly 1916. As may be seen in FIG. 19A, the floating wall brackets 1902 are placed on floating base plate member 1904 at the bottom of the floating wall assembly 1916. The floating wall brackets hold vertical members 1908 such that floating space 1900 is provided. The vertical members are attached to top/non-floating plate member 1910, which is attached to the floor joists (not shown) of the next level up.

Figure 19B:
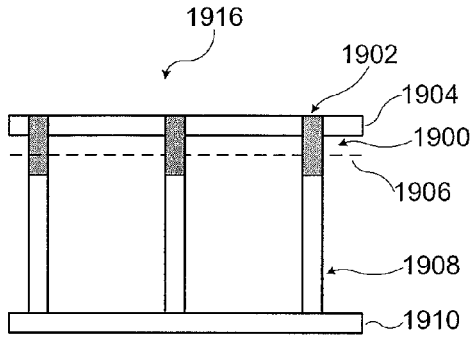
FIG. 19B is a schematic illustration of placement of floating wall brackets at the top of a floating wall assembly.

FIG. 19B is a schematic illustration of placement of floating wall brackets 1902 at the top of a floating wall assembly 1916. FIG. 19B shows an installation that is the reverse of the typical floating wall installation of FIG. 19A. The floating wall assembly 1916 may be assembled with the floating wall brackets 1902 and the floating base plate member 1904 (now acting as the traditional top plate) at the top of the floating wall assembly 1916. The vertical studs 1908 would be directly fastened to the non-floating plate 1910 (acting as a traditional base plate) and inserted into the floating wall brackets 1902 at the top of the floating wall 1916. In this way the floating space 1900 would be at the top of the floating wall 1916.

Figure 19C:
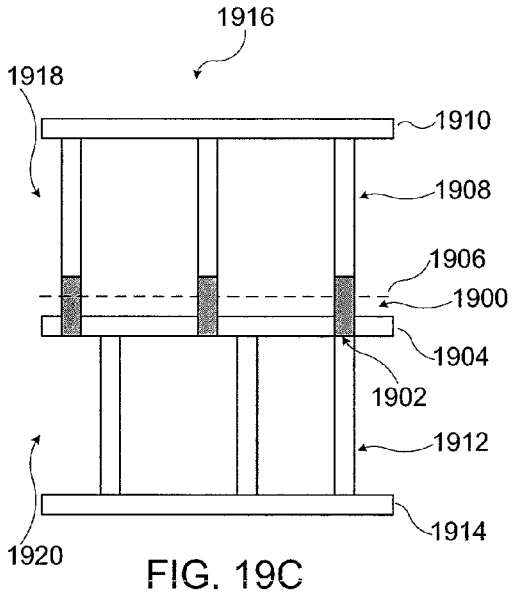
FIG. 19C is a schematic illustration of placement of floating wall brackets at the base of a top portion of a floating wall assembly.

FIG. 19C is a schematic illustration of the placement of floating wall brackets 1902 at the base of a top portion 1918 of a floating wall assembly 1916 such that the floating space 1900 is at some intermediate point between the top and bottom of the floating wall 1916. As may be seen in FIG. 19C, the floating wall brackets 1902 are placed on floating base plate member 1904 at the bottom of the top portion 1918 of floating wall assembly 1916. The floating wall brackets hold vertical members 1908 such that floating space 1900 is provided. The vertical members are attached to top/non-floating plate member 1910, which is attached to the floor joists (not shown) of the next level up. Instead of attaching the floating base plate member 1904 directly to the floating slab/floor, the floating base plate 1904 is now attached to a standard constructed lower wall portion 1920 having vertical members 1912 attached between the floating base plate member 1904 and the wall base plate 1914 that is attached to the floating slab/floor.

Figure 19D:
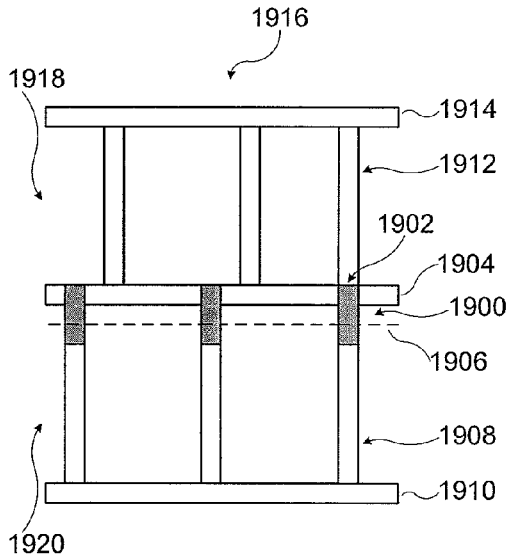
FIG. 19D is a schematic illustration of the placement of floating wall brackets at the top of a bottom portion of a floating wall assembly.

FIG. 19D is a schematic illustration of the placement of floating wall brackets 1902 at the top of a bottom portion 1920 of a floating wall assembly 1916 such that the floating space 1900 is at some intermediate point between the top and bottom of the floating wall 1916. As may be seen in FIG. 19D, the floating wall brackets 1902 are placed on floating base plate member 1904 at the top of the bottom portion 1920 of floating wall assembly 1916. The floating wall assembly 1916 may be assembled with the floating wall brackets 1902 and the floating base plate member 1904 (now acting as more of a traditional top plate) at the top of bottom portion 1920 of the floating wall assembly 1916. The vertical studs 1908 would be directly fastened to the non-floating plate 1910 (acting as a traditional base plate) and inserted into the floating wall brackets 1902 at the top of the bottom portion 1920 of the floating wall assembly 1916. Instead of attaching the floating base plate member 1904 directly to the floor joist(s) of the next level up as was done in FIG. 19B, the floating base plate 1904 is now attached to a standard constructed upper wall portion 1918 having vertical members 1912 attached between the floating base plate member 1904 and the wall top plate 1914 that is attached to the floor joists of the next level up.

Figure 20A:
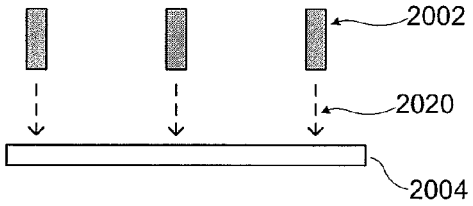
FIGS. 20A-E are schematic illustrations of example processes for building a floating wall assembly using floating wall brackets.
Figure 20B:
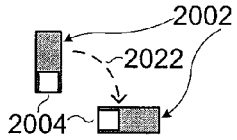
Figure 20C:
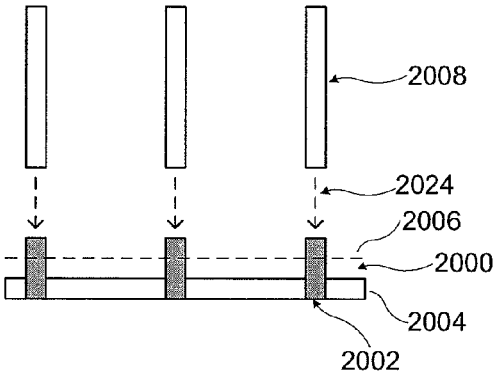
Figure 20D:
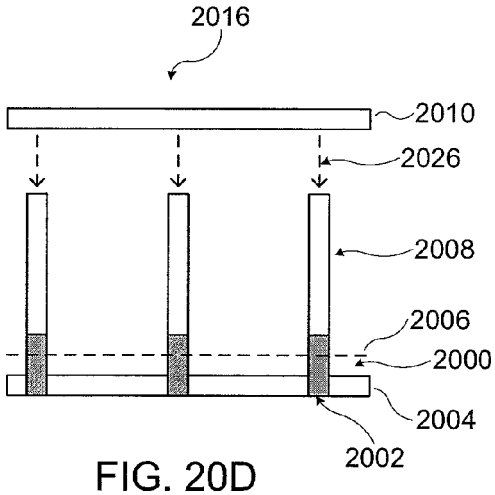
Figure 20E:
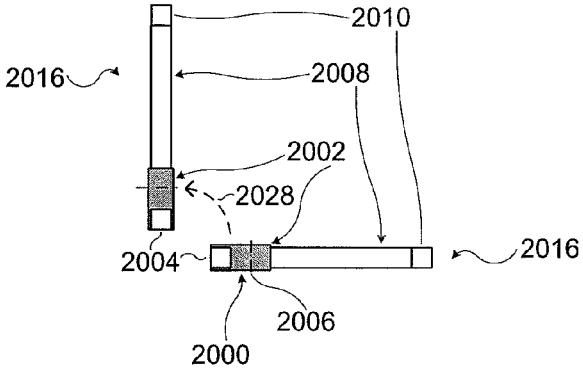

FIGS. 20A-E are schematic illustrations of example processes for building/constructing a floating wall assembly 2016 using floating wall brackets 2002. In FIG. 20A, attaching a plurality of floating wall brackets 2002 are attached 2020 to a floating base plate member 2004. In FIG. 20B, a builder may optionally rotate 2022 the floating base plate member 2004 attached with the plurality of floating wall brackets 2002 substantially ninety degrees such that for the process shown in FIG. 20C, the vertical members 2008 are placed in the floating wall brackets 2002 horizontally rather than vertically and the non-floating plate member 2010 in the process shown in FIG. 20D is also attached in the horizontal position. In FIG. 20C, one end of a vertical member 2008 from a plurality of vertical members 2008 is placed/slipped into an opening of each of the plurality of floating wall brackets 2002 such that each of the plurality of vertical members 2008 placed 2024 into each of the plurality of floating wall brackets 2002 is substantially perpendicular to the floating base plate member 2004 and is held in place in each of the plurality of floating wall brackets 2002 by at least one friction means of each of the floating wall brackets 2002 such that a desired float space 2000 between the end of each of the plurality of vertical members 2006 and the floating base plate member 2004 is established. In FIG. 20D, the other end of each of the vertical members 2008 are attached 2026 to a non-floating plate member 2010 to create a floating wall assembly 2016. In FIG. 20E, if the builder optionally built the floating wall assembly 2016 in a horizontal position, the floating wall assembly 2016 may be rotated 2028 from the horizontal position substantially ninety degrees to a substantially vertical position for leveling and installing of the floating wall assembly. With the floating wall assembly 2016 in a vertical position, the floating wall assembly 2016 may be leveled by adjusting placement of each of the plurality of vertical members 2008 in each of the plurality of floating wall brackets 2002 and installed between a floating slab and at least one next level up floor joist.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method for constructing a floating wall using floating wall brackets comprising:

attaching a plurality of floating wall brackets to a floating base plate member;

placing one end of a vertical member from a plurality of vertical members into an opening of each of said plurality of floating wall brackets such that each of said plurality of vertical members placed into each of said plurality of floating wall brackets is substantially perpendicular to said floating base plate member and is held in place in each of said plurality of floating wall brackets by at least one friction means of each of said floating wall brackets such that a desired float space between said end of each of said vertical members and said floating base plate member is established;

attaching the other end of each of said vertical members to a non-floating plate member to create a floating wall assembly;

leveling said floating wall assembly by adjusting placement of each of said plurality vertical members in each of said plurality of floating wall brackets; and installing said floating wall assembly between a floating slab and at least one next level up floor joist.

2. The method of claim 1 further comprising:

rotating said floating base plate member attached with said plurality of floating wall brackets substantially ninety degrees such that said vertical members are placed in said floating wall brackets horizontally rather than vertically and said non-floating plate member is attached in said horizontal position; and rotating said floating wall assembly from said horizontal position substantially ninety degrees to a substantially vertical position for leveling and installing of said floating wall assembly.

3. The method of claim 1 wherein the floating wall bracket location on the floating wall assembly is one of a group consisting of: at a bottom of said floating wall assembly such that said floating wall base plate is attached to said floating slab when installing said floating wall assembly, at a top of said floating wall assembly such that said floating wall base plate is attached to said at least one upper level floor joist, at an intermediate position in an overall floating wall such that said floating wall brackets are at a base of an upper portion of said overall floating wall, and at an intermediate position in an overall floating wall such that said floating wall brackets are at a top of a lower portion of said overall floating wall.

4. A floating wall bracket for constructing floating walls in building/structure construction comprising:

bracket walls having a perimeter substantially in a shape of a cross-section of a vertical member to be placed into said floating wall bracket, said perimeter of said bracket walls substantially sized such that said cross-section of said vertical member fits within said bracket walls, said bracket walls having an open end for accepting said vertical member and a base end that abuts a floating base plate member disposed substantially perpendicular to said vertical member, said bracket walls extending from said open end toward said base end such that said vertical member may securely fit within said bracket walls, at least a portion of said bracket walls further extending to said base end, at least one fastening tab disposed from said base end of said bracket walls and extending perpendicular to said bracket walls such that said fastening tab may be aligned linearly with said floating base plate member, said at least one fastening tab having at least one attachment means for attaching said at least one fastening tab of said floating wall bracket to said floating base plate member;

at least one friction means incorporated into said floating wall bracket that acts on said vertical member to support said vertical member within said floating wall bracket, said at least one friction means providing enough friction to hold the weight of said vertical member within said floating wall bracket without said vertical member freely moving within said bracket walls, said at least one friction means limiting friction provided such that said vertical member will slide within said bracket walls once a floating wall assembly comprised of at least one floating wall bracket is attached to floor joists of an upper level, said at least one friction means incorporated within said floating wall bracket such that said vertical member will have a desired amount of floating space between an end of said vertical member placed within said bracket walls of said floating wall bracket and said floating base plate member at said base end of said bracket walls.

5. The floating wall bracket of claim 4 further comprising at least one guide/lateral support flange disposed from said base end of said bracket walls and parallel to said bracket walls, said at least one guide/lateral support flange sized and placed on said floating wall bracket so as to act as a guide to placing said floating wall bracket on said floating base plate member and so as to provide additional lateral support for said vertical member attached to said floating base plate member via said floating wall bracket.

6. The floating wall bracket of claim 5 wherein:

said shape of said perimeter of said bracket walls is substantially rectangular;

said at least one fastening tab disposed from said base end of said bracket walls and extending perpendicular to said bracket walls further comprises at least one fastening tab on each of two sides of said bracket walls, said two sides of said bracket wall being opposing sides of said rectangular shape of said bracket walls;

said at least one guide/lateral support flange disposed from said base end of said bracket walls and parallel to said bracket walls further comprises at least one guide/lateral support flange on remaining two sides of said bracket walls, said remaining two sides of said bracket wall being opposing sides of said rectangular shape of said bracket wall and not said two sides of said bracket wall having said at least one fastening tab.

7. The floating wall bracket of claim 4 further comprising an opening within said bracket walls that provides a user an ability to locate said end of said vertical member placed within said bracket walls.

8. The floating wall bracket of claim 4 wherein said at least one friction means is comprised of at least one of a group consisting of: a score tab on said bracket wall, a scoring spike on said bracket wall, a scoring device on said bracket wall, a button indentation on said bracket wall, a spike disposed vertically extending upward within said bracket walls from said base end of said bracket walls towards said vertical member, and a fastener slot opening on said bracket wall having fasteners attached to said vertical member through said fastener slot opening.

9. The floating wall bracket of claim 4 wherein said attachment means for said at least one fastening tab is comprised of at least one of a group consisting of: at least one hole for permitting at least one nail to be driven into said floating base member through said fastening tab, at least one hole for permitting at least one screw/bolt to be screwed into/attached to said floating base member through said fastening tab, at least one hole for permitting at least one rivet to be attached to said floating base member through said fastening tab, glue, double sided tape, and other adhesive materials.

10. The floating wall bracket of claim 4 wherein said cross-section shape of said vertical member is one of a group consisting of: rectangle, square, triangle, circle, oval, other standard geometric shapes, and irregular/non-geometric shapes.

11. The floating wall bracket of claim 4 wherein said floating wall bracket is based upon a single manufacturing pattern metal piece cut/stamped from flat-rolled/sheet metal and bent and fabricated into said floating wall bracket.

12. The floating wall bracket of claim 11 wherein said floating wall bracket is based upon a two manufacturing pattern metal pieces cut/stamped from flat-rolled/sheet metal and bent and fabricated into two halves of said floating wall bracket and said two halves of said floating wall bracket are further attached together to make said floating wall bracket.

13. The floating wall bracket of claim 4 wherein a material of construction of said floating wall bracket is comprised of at least one of a group consisting of: at least one manufacturing pattern metal piece cut/stamped from flat-rolled/sheet metal, PVC (PolyVinyl Chloride), plastic, molded plastic, and casted/molded metal.

* * * * *